United States Patent [19]

Meyer

[11] Patent Number: 4,652,314

[45] Date of Patent: Mar. 24, 1987

[54] PROCESS FOR PRODUCING PRODUCTS OF AL-LI-MG-CU ALLOYS HAVING HIGH LEVELS OF DUCTILITY AND ISOTROPY

[75] Inventor: Philippe Meyer, Voiron, France

[73] Assignee: Cegedur Societe de Transformation de l'Aluminium Pechiney, Paris, France

[21] Appl. No.: 710,698

[22] Filed: Mar. 11, 1985

[30] Foreign Application Priority Data

Mar. 15, 1984 [FR] France ..... 84 04481

[51] Int. Cl.[4] ..... C22F 1/04

[52] U.S. Cl. ..... 148/2; 148/11.5 A; 148/12.7 A

[58] Field of Search ..... 148/11.5 A, 12.7 A, 148/159, 2

[56] References Cited

U.S. PATENT DOCUMENTS 4,526,630 7/1985 Field ..... 148/159

*Primary Examiner*—R. Dean

*Attorney, Agent, or Firm*—Dennison, Meserole, Pollack & Scheiner

[57] ABSTRACT

The invention concerns a process for producing products of Al-base alloys essentially containing Li, Mg and Cu as main alloy elements and having a high level of ductility and isotropy. The process comprises subjecting the homogenized product to a "tepid" transformation operation at from 100° to 420° C. The intermediate annealing operations, if required, are carried out in the range of from 200° to 550° C. The rate of cooling after the intermediate annealing operations is generally kept at from 1500° C./second to 30° C./hour. The isotropy and ductility of the resulting products are considerably improved in comparison with the prior art processes.

7 Claims, 2 Drawing Figures

Figure 1:
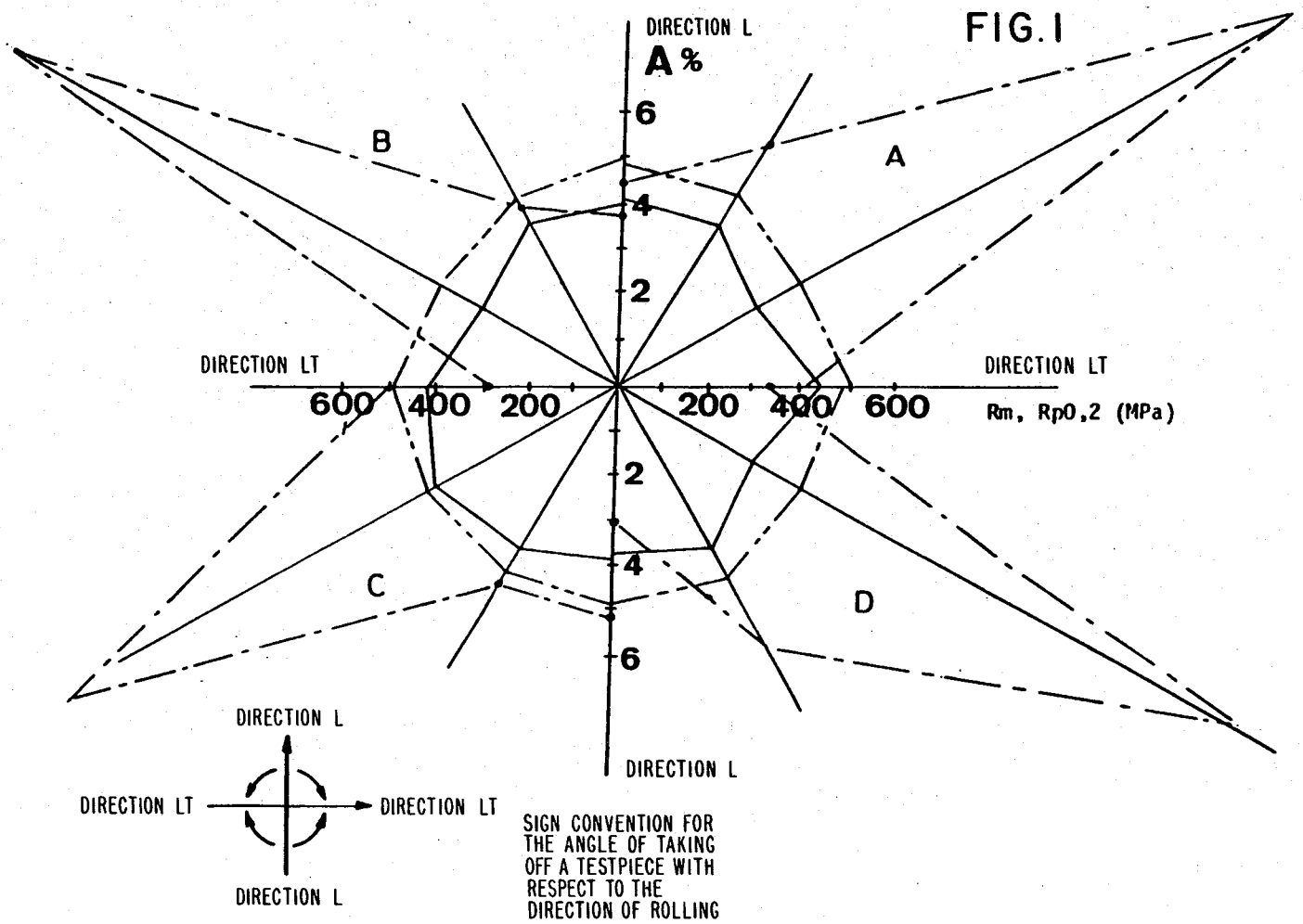

FIG. I
DIRECTION L
A %
6
4
2
DIRECTION LT
Rm, Rp0,2 (MPa)
600
400
200
A
B
C
D
DIRECTION L
DIRECTION LT
SIGN CONVENTION FOR THE ANGLE OF TAKING OFF A TESTPIECE WITH RESPECT TO THE DIRECTION OF ROLLING

A%
8
6
4
2
2
4
6
8
10
Rm, Rp0,2 (MPa)
200
400
600
800
200
400
600
800
DIRECTION LT
DIRECTION L
DIRECTION L
DIRECTION LT
E
F
2
1
DIRECTION L
DIRECTION LT
DIRECTION LT
DIRECTION L
SIGN CONVENTION FOR THE ANGLE OF TAKING OFF A TESTPIECE WITH RESPECT TO THE DIRECTION OF ROLLING

PROCESS FOR PRODUCING PRODUCTS OF AL-LI-MG-CU ALLOYS HAVING HIGH LEVELS OF DUCTILITY AND ISOTROPY

The invention concerns a process for producing products of Al-base alloys essentially containing Li, Mg and Cu as main alloy elements and having a high level of ductility and isotropy.

The conventional production ranges schedule which comprise in particular an operation for homogenization of the initial products which are obtained either by casting or by powder metallurgy, optionally a scalping operation, hot transformation, cold transformation with one or more intermediate annealing operations if required, solution treatment and tempering, with an optional cold working operation for stress relief between the last two operations mentioned, when used in relation to alloys of the family Al-Li-Mg-Cu, result in mechanical tensile characteristics (tensile strength Rm, yield strength Rp 0.2 and ductility A%) which vary very substantially in dependence on the direction of measurement with respect to the principal direction of hot and cold transformation (long direction) of the products.

That is particularly true in regard to flat products such as plates, billets, strips or sheets. It results in well-known disadvantages in the subsequent operation of shaping the products, for example when pressing or stamping a sheet (the earing formation, local ruptures, etc . . . ) or upon final utilization thereof.

The method according to the invention makes it possible substantially to improve the isotropy of the mechanical characteristics of products of alloy type Al-Li-Mg-Cu, while also enhancing their ductility.

The method comprises subjecting a homogenized product to a hot transformation operation at a temperature of less than 420° C., in general between 100° and 400° C. and preferably between 300° and 350° C., to the desired final dimensions or to intermediate dimensions. When the final dimensions are directly attained, this "tepid" transformation operation is followed by conventional solution treatments (in general between 500° and 550° C. according to the alloy) and thermomechanical treatments for producing structural hardening.

The intermediate product is generally brought to the final dimensions by cold transformation, effecting one or more intermediate annealing operations, if that is required. Such operations may be carried out just before the cold transformation operation and/or in the course thereof. In that case, one of the above-mentioned annealing operations is carried out in a temperature range of between 200° and 550° C. The temperature hold times are of the order of from a few minutes to several hours, the shortest periods generally being associated with the highest temperatures.

It was observed that the rate of cooling after the intermediate annealing operation or operations is an important parameter of the process and is preferably to be between 1500° C./second and 30° C./hour. Rates higher than 1500° C./second are difficult to attain on an industrial scale, except in relation to a product of very small thickness, and rates of less than 30° C./hour do not provide any substantial improvement in isotropy.

As is known, the intermediate annealing operation or operations may be carried out in salt bath furnaces (nitrite-nitrate, nitrate-nitrate), or in static ventilated air furnaces, or in tunnel furnaces.

After the cold transformation operation, the products are subjected to the usual solution treatment, quenching and thermomechanical treatment for structural hardening, the solution treatment ipso facto constituting the final annealing operation.

The invention will be better appreciated by means of the following Examples relating to sheets, it being appreciated that it can be applied to other forms of worked products such as forged, die-stamped or extruded products.

Figure 2:
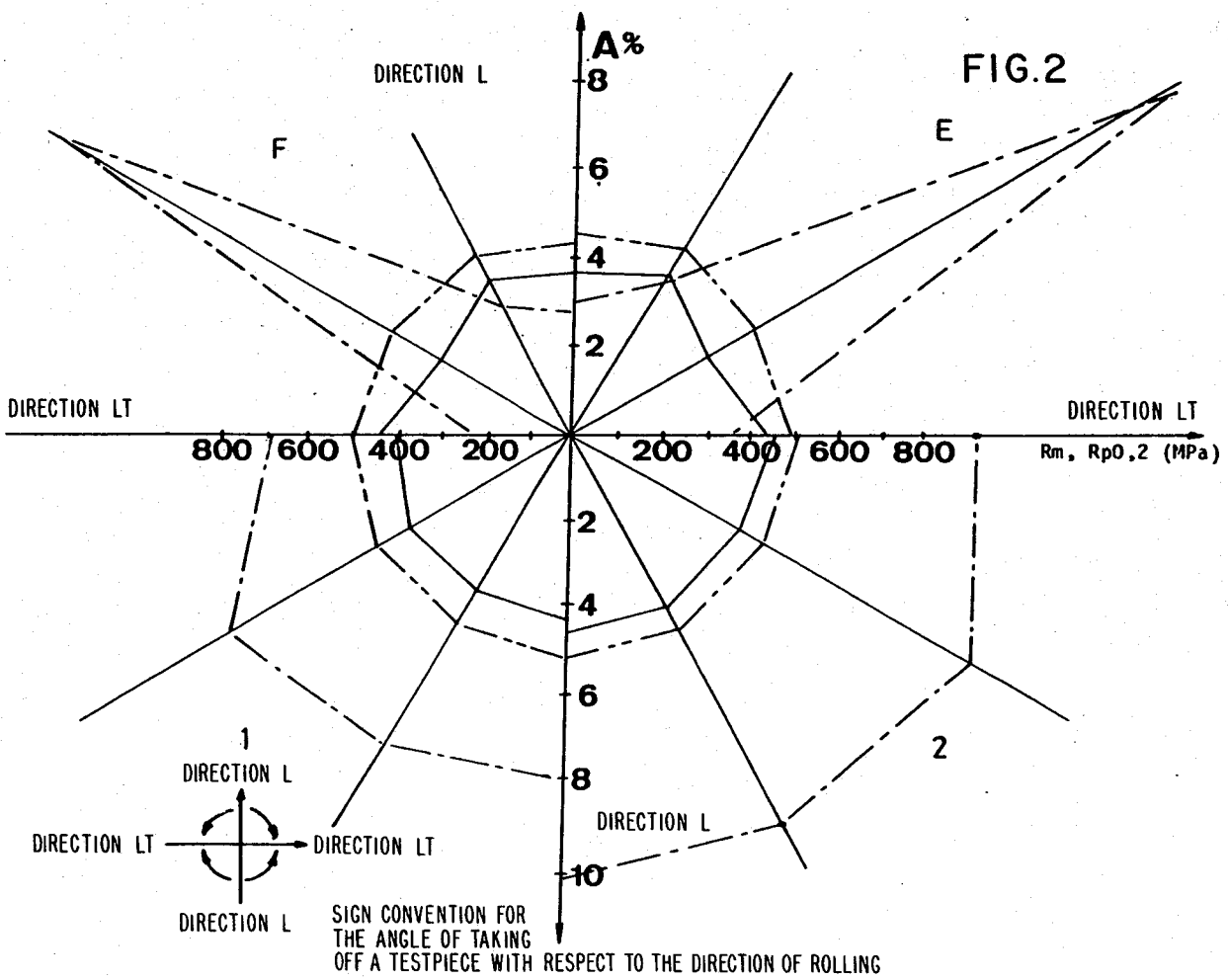

FIGS. 1 and 2 show in polar coordinates the variations in the mechanical tensile characteristics obtained on sheets, according to the direction of measurement, in accordance with the conventional ranges (references A to F) or in accordance with the invention (references 1 and 2).

EXAMPLE 1

An alloy containing (by weight) 2.76% Li-1.32% Cu-1.04% Mg-0.11% Zr-0.02% Fe-0.02% Si, with the balance Al, was cast in the form of a plate measuring 300×100 mm, homogenized at 533° C. for 24 hours, scalped and hot rolled at 470° C.–420° C. to a thickness of 5 mm.

Taking that blank, the hot and cold transformation operations, down to a thickness of 1.6 mm, were carried out under the conditions set forth in Table I, in accordance with a conventional range, the hot rolling operation (HR) being performed at from 470° to 420° C. approximately and the cold rolling operation (CR) being performed at ambient temperature.

The sheets were then subjected to a solution treatment at 533° C. for 30 minutes (ventilated furnace), quenching with cold water, a controlled traction of 3.5%, then tempering for 24 hours at 190° C.

Tensile testpieces were taken off in the directions 0° (long direction L), 30°, 60° and 90° (long transverse direction LT) with respect to the direction of rolling.

Schedule

Annealing in a salt bath 533° C.–7 min
Quenching: cold water
Rolling: cold, to 1.6 mm
Solution treatment: 30′ at 533° C. in a salt bath
Quenching: cold water
Traction: controlled 3.5%
Tempering: 24 hours at 190° C.

Schedule

Annealing in a furnace in air 533° C.–7 min
Cooling: slow (25° C./hour)
Rolling: cold, to 1.6 mm
Solution treatment: 30′ at 533° C. in a salt bath
Quenching: cold water
Controlled traction: 3.5%
Tempering: 24 hours at 190° C.

Schedule

Annealing in a furnace in air 350° C.–1 hour 30 minutes
Cooling: slow (25° C./hour)
Rolling: cold, to 1.6 mm
Solution treatment: 30′ at 533° C. in salt bath
Quenching: cold water
Traction: controlled 3.5%
Tempering: 24 hours at 190° C.

The tensile testpieces were taken off under the same conditions as above.

The results obtained are set forth in Table II and are shown in graph form in FIGS. 1 and 2.

EXAMPLE 2

An alloy containing (% by weight) 2.10% Li-2.38% Cu-1.30% Mg-0.11% Zr-0.02% Fe-0.02% Si, the balance Al, was cast in plate form (300×100 mm), homogenized at 526° C. for 24 hours, rolled between 350° and 300° C. to a thickness of 3.2 mm, annealed at 350° C. for 1 hour 30 minutes in a furnace in air, subjected to slow cooling (20° C./hour), cold rolled to 1.6 mm in thickness, subjected to solution treatment at 526° C. for 30 minutes, quenched with cold water, subjected to 2% traction and subjected to tempering for 20 hours at 190° C.

The results of traction tests obtained in different directions are set forth in Table III.

EXAMPLE 3

An alloy containing (% by weight) 2.7% Li-1.6% Cu-1.0% Mg-0.11% Zr-0.04% Fe-0.03% Si, with the balance Al, was cast and transformed in accordance with the conditions specified in relation to Example 2, except as regards the controlled traction operation which was performed after quenching, which was at 5%.

The traction results obtained are set forth in Table IV.

The Examples according to the invention clearly show that the applied range results in highly isotropic products, the degree of elongation of which is generally higher than 7%.

TABLE I

| Thickness | Ref. A | B | C | D | E | F |
|---|---|---|---|---|---|---|
| 5 mm | Annealing | ↓ | ↓ | ↓ | ↓ | ↓ |
| | ↓ | HR | ↓ | ↓ | ↓ | ↓ |
| | ↓ | ↓ | HR | ↓ | ↓ | ↓ |
| 4 mm | CR | Annealing | ↓ | ↓ | ↓ | ↓ |
| | ↓ | ↓ | ↓ | HR | ↓ | ↓ |
| 3.2 mm | ↓ | ↓ | Annealing | ↓ | ↓ | ↓ |
| | ↓ | ↓ | ↓ | ↓ | HR | HR |
| | ↓ | CR | ↓ | ↓ | ↓ | ↓ |
| 2.5 mm | Annealing | ↓ | ↓ | Annealing | ↓ | ↓ |
| | ↓ | ↓ | CR | ↓ | ↓ | ↓ |
| | CR | ↓ | ↓ | ↓ | Annealing | ↓ |
| 2.0 mm | ↓ | Annealing | ↓ | CR | ↓ | ↓ |
| | ↓ | CR | ↓ | ↓ | HR | ↓ |
| 1.6 mm | ↓ | ↓ | ↓ | ↓ | ↓ | ↓ |

Annealing: 1 hour at 300° C., slow cooling (20 to 25° C./hour) to 100° C.

TABLE II

| Range | Directions: Long (0°) Rp 0.2 (MPa) | Rm (MPa) | A % | 30° Rp 0.2 (MPa) | Rm (MPa) | A % | 60° Rp 0.2 (MPa) | Rm (MPa) | A % | Long transverse (90°) Rp 0.2 (MPa) | Rm (MPa) | A % |
|---|---|---|---|---|---|---|---|---|---|---|---|---|
| A | 411 | 497 | 4.5 | 413 | 492 | 6.2 | 346 | 452 | 16.6 | 450 | 504 | 4.0 |
| B | 407 | 500 | 3.8 | 411 | 470 | 4.5 | 349 | 462 | 15.9 | 417 | 486 | 2.9 |
| C | 388 | 484 | 5.0 | 412 | 472 | 5.0 | 349 | 461 | 13.6 | 420 | 490 | 5.0 |
| D | 386 | 474 | 3.0 | 412 | 489 | 6.6 | 344 | 459 | 15.6 | 441 | 493 | 3.4 |
| E | 381 | 449 | 3.0 | 418 | 479 | 4.0 | 347 | 467 | 15.2 | 436 | 496 | 3.6 |
| F | 373 | 437 | 2.8 | 408 | 466 | 3.4 | 352 | 489 | 13.6 | 444 | 496 | 2.3 |
| 1 | 429 | 506 | 7.8 | 414 | 499 | 8.1 | 414 | 500 | 8.9 | 405 | 499 | 6.8 |
| 2 or 3 | 451 | 505 | 10.1 | 452 | 510 | 10.1 | 448 | 506 | 10.5 | 450 | 506 | 9.1 |

TABLE III

| Angle between the direction of taking a testpiece and the rolling direction | Rp 0.2 (MPa) | Rm (MPa) | A % |
|---|---|---|---|
| 0° | 406 | 457 | 12.0 |
| 30° | 411 | 457 | 12.9 |
| 60° | 399 | 458 | 13.2 |
| 90° | 403 | 460 | 12.1 |

TABLE IV

| Angle between the direction of taking a testpiece and the rolling direction | Rp 0.2 (MPa) | Rm (MPa) | A % |
|---|---|---|---|
| 0° | 504 | 552 | 7.6 |
| 30° | 506 | 552 | 7.2 |
| 60° | 498 | 498 | 7.0 |
| 90° | 505 | 551 | 6.8 |

I claim:

1. In a process for producing products of Al-base alloys comprising Li, Mg and Cu as principal alloy elements and comprising the steps of melting and casting the alloy, hot transformation, solution treatment, quenching, and tempering the improvement comprising said hot transformation being carried out while said alloys are maintained within a temperature range of 100° to 350° C.

2. A process according to claim 1 characterised in that said range extends between 300° and 350° C.

3. A process according to claim 1 wherein cold transformation is carried out between said hot transformation and quenching steps.

4. A process according to claim 3 wherein said cold transformation includes at least an intermediate annealing step.

5. A process according to claim 3 characterised in that at least one intermediate annealing operation is carried out before the cold transformation operation and/or during same in the temperature range of between 200° and 550° C.

6. A process according to claim 5 characterised in that the at least one rate of cooling after the intermediate annealing operation is between 1500° C./second and 30° C./hour.

7. A process according to claim 1 wherein cold deformation is carried out between said quenching and tempering steps.

* * * * *